US011092008B2

(12) United States Patent
Abramcyk

(10) Patent No.: US 11,092,008 B2
(45) Date of Patent: Aug. 17, 2021

(54) GRADER BIT

(71) Applicant: Ironhawk Industrial Distribution, LLC, Euclid, OH (US)

(72) Inventor: Ron Abramcyk, Euclid, OH (US)

(73) Assignee: IronHawk Industrial Distribution LLC, Euclid, OH (US)

( * ) Notice: Subject to any disclaimer, the term of this patent is extended or adjusted under 35 U.S.C. 154(b) by 0 days.

(21) Appl. No.: 16/701,846

(22) Filed: Dec. 3, 2019

(65) Prior Publication Data

US 2021/0164347 A1 Jun. 3, 2021

(51) Int. Cl.

| | |
|---|---|
| ***E21C 35/19*** | (2006.01) |
| ***E21C 35/197*** | (2006.01) |
| ***E01C 23/12*** | (2006.01) |
| ***E01C 23/088*** | (2006.01) |

(52) U.S. Cl.
CPC ..... *E21C 35/197* (2013.01); *E01C 23/088* (2013.01); *E01C 23/127* (2013.01)

(58) Field of Classification Search
CPC ..... E21C 35/197; E21C 35/1831
See application file for complete search history.

(56) References Cited

U.S. PATENT DOCUMENTS

| | | | |
|---|---|---|---|
| 4,833,801 | A | 5/1989 | Winter |
| 4,899,472 | A | 2/1990 | Winter |
| 5,265,356 | A | 11/1993 | Winter |
| 5,559,286 | A | 9/1996 | White et al. |
| 6,702,393 | B2 | 3/2004 | Mercier |
| 6,709,065 | B2 | 3/2004 | Peay et al. |
| 6,799,388 | B2 | 10/2004 | Weaver et al. |
| 6,922,924 | B2 | 8/2005 | Jones et al. |
| 7,353,628 | B2 | 4/2008 | Potak |
| 7,367,407 | B2 | 5/2008 | Lannert |
| 7,836,615 | B2 | 11/2010 | Winter |
| 7,874,085 | B1 | 1/2011 | Winter et al. |
| 7,997,660 | B2 | 8/2011 | Monyak et al. |
| D654,937 | S | 2/2012 | Fader et al. |
| 8,191,287 | B2 | 6/2012 | Winter et al. |
| 8,449,041 | B2 | 5/2013 | Monyak et al. |
| 8,517,473 | B2 | 8/2013 | Monyak et al. |
| 8,570,030 | B2 | 10/2013 | Morton |

(Continued)

OTHER PUBLICATIONS

SCC Cover caps for socket head cap screws NBK www.nbk1560.com retrieved Oct. 7, 2020 (Year: 2016).*

(Continued)

*Primary Examiner* — Janine M Kreck
(74) *Attorney, Agent, or Firm* — BakerHostetler

(57) ABSTRACT

A grader bit comprising a tool end having a shank extending axially inward therefrom; the shank having a circular cross-section; wherein a first shoulder extends radially outward relative to the shank and is located axially inward of the tool end; a second shoulder extending radially outward relative to the shank is located axially inward of the first shoulder, wherein the first shoulder and second shoulder are separated from each other by a spacing; the shank including a boss at an axial inward end thereof, the boss defining a socket extending inward into the shank from the axial inward extremity of the shank, wherein a perimeter of the socket includes at least one facet against which a force is applied to cause rotation of the shank.

19 Claims, 8 Drawing Sheets

(56) References Cited

U.S. PATENT DOCUMENTS

| | | | | |
|---|---|---|---|---|
| 8,678,516 | B2 * | 3/2014 | Fader | E21C 35/19 299/104 |
| 8,727,451 | B2 * | 5/2014 | Fader | E21C 35/18 299/107 |
| 8,844,173 | B2 | 9/2014 | Winter et al. | |
| 8,984,778 | B2 | 3/2015 | Fox et al. | |
| 9,163,379 | B2 | 10/2015 | Winter | |
| D745,584 | S | 12/2015 | Heilmeier et al. | |
| D745,585 | S | 12/2015 | Heilmeier et al. | |
| D746,884 | S | 1/2016 | Heilmeier et al. | |
| 9,290,898 | B2 | 3/2016 | Abramczk et al. | |
| 9,388,544 | B2 | 7/2016 | Reeves et al. | |
| 9,428,874 | B2 | 8/2016 | Winter et al. | |
| 9,562,342 | B2 | 2/2017 | Winter et al. | |
| 9,605,538 | B2 | 3/2017 | Voitic et al. | |
| 9,708,784 | B2 | 7/2017 | Winter et al. | |
| 9,821,396 | B2 | 11/2017 | Winter | |
| D816,720 | S | 5/2018 | Winter et al. | |
| 9,956,667 | B2 | 5/2018 | Bjormander | |
| D824,962 | S | 8/2018 | Winter | |
| 10,066,371 | B2 | 9/2018 | Winter | |
| 10,113,282 | B2 | 10/2018 | Behan et al. | |
| D839,315 | S | 1/2019 | Winter et al. | |
| 10,167,598 | B2 | 1/2019 | Stemerman et al. | |
| D839,925 | S | 2/2019 | Winter | |
| D839,926 | S | 2/2019 | Winter | |
| D839,927 | S | 2/2019 | Winter et al. | |
| D839,928 | S | 2/2019 | Winter | |
| 10,400,404 | B2 | 9/2019 | Hawkins | |
| D863,368 | S | 10/2019 | Abramczyk et al. | |
| 2003/0123934 | A1 | 7/2003 | Weaver et al. | |
| 2003/0137185 | A1 * | 7/2003 | Sollami | E21C 35/197 299/106 |
| 2005/0098015 | A1 * | 5/2005 | Latham | E21C 35/1936 83/698.41 |
| 2006/0033379 | A1 * | 2/2006 | Frear | E21C 35/197 299/107 |
| 2007/0257545 | A1 | 11/2007 | Mouthaan et al. | |
| 2007/0277403 | A1 | 12/2007 | Summer | |
| 2010/0148568 | A1 * | 6/2010 | Latham | E21C 35/19 299/111 |
| 2016/0333547 | A1 | 11/2016 | Winter et al. | |
| 2017/0191236 | A1 | 7/2017 | Winter | |
| 2018/0161881 | A1 | 6/2018 | Akerman et al. | |
| 2019/0112781 | A1 | 4/2019 | Winter et al. | |

OTHER PUBLICATIONS

Sandvik Construction Tools Grading RC500; Sandvik Construction; www.construction.sandvik.com; 16 pages.

"Haul Road Maintenance—Scarifier Blades Accessories: End Protectors"; Kennametal; www.kennametal.com; 5 pages.

"Price Sheet"; Mar. 2017; one page.

* cited by examiner

GRADER BIT

TECHNICAL FIELD

In general, the present disclosure relates to a grader bit for a scarifier tool. More particularly, the disclosure relates to a grader bit having a socketed shank to facilitate use of a tool to rotate the grader bit and clear accumulated debris.

SUMMARY

The present disclosure general relates to a grader bit comprising a tool end having a shank extending axially inward therefrom; the shank having a circular cross-section; wherein a first shoulder extends radially outward relative to the shank and is located axially inward of the tool end; a second shoulder extending radially outward relative to the shank is located axially inward of the first shoulder defining a spacing therebetween; the shank including a boss at an axial inward end thereof, the boss defining a socket extending inward into the shank from the axial inward extremity of the shank, wherein a perimeter of the socket includes at least one facet against which a force is applied to cause rotation of the shank.

The present disclosure also relates to a grader bit comprising a tool end and a shank; the shank extending inward from the tool end, the shank having a circular cross-section defining an axis; wherein the shank includes a first shoulder located inward of the tool end, and a second shoulder located inward of the first shoulder, wherein the first shoulder and second shoulder are separated from each other by a spacing; the first shoulder having a first diameter, the second shoulder having a second diameter, and a portion of the shank between the first shoulder and second shoulder having a diameter, wherein the first diameter and second diameter are greater than the diameter of the shank between the first shoulder and second shoulder; the shank including a boss at an axial inward end thereof, the boss defining a socket extending from an end of the boss toward the second shoulder, the socket including at least one wall forming a perimeter of the socket, wherein the at least one wall includes at least one facet against which a force is applied to cause rotation of the shank; a retainer supported on the shank between the first shoulder an second shoulder, wherein the spacing between the first shoulder and second shoulder is greater than the length of the retainer by no less than 0.1 mm and no more than 2.75 mm.

Figure 1:
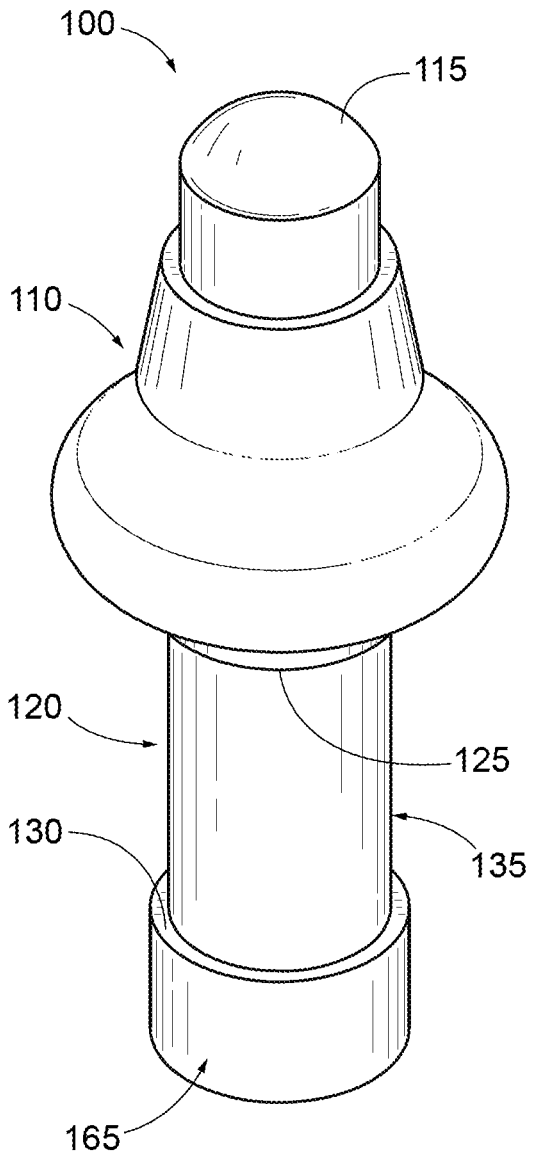
FIG. 1 is a top perspective view of a grader bit according to the disclosure.

The following description and the annexed drawings set forth in detail certain illustrative aspects of the claimed subject matter. These aspects are indicative, however, of but a few of the various ways in which the principles of the innovation may be employed and the claimed subject matter is intended to include all such aspects and their equivalents. Other advantages and novel features of the claimed subject matter will become apparent from the following detailed description of the innovation when considered in conjunction with the drawings.

DETAILED DESCRIPTION

In general, the following disclosure relates to grader bits for a scarifier tool. A scarifier tool typically is a fixed blade-like member that is mounted on a vehicle and pushed or dragged along a road surface or other surface that needs maintenance. The blade-like member acts as a support for one or more grader bits that may be arranged like teeth in a comb. The grader bits may rotate to help clear debris as the scarifier tool is moved along the surface. Maintenance operations on a surface may include grooming or maintaining dirt and gravel roads; removing hard-packed snow and ice; chip and seal road reclamation; tar sand road reclamation; spot asphalt milling; spreading loose material; clearing storm debris; raking; and mixing salt or dust suppressants for road use.

An example of at least a portion of a scarifier tool 10 is shown in the drawings. Scarifier tool is dragged or pushed during operation. In general, scarifier tool includes a support 15 for one or more grader bits 100. The support 15 may be attached to or formed as part of a mold board for a plow or other implement used to perform scarifying operations. In some instances, the scarifier tool is mounted directly to a vehicle or implement that attaches to a vehicle. The scarifier tool 10 and support 15 may have a variety of configurations depending on the application of the scarifier tool 10. The scarifier tool 10 may be sold as a single piece of made up of multiple pieces that are joined to form the desired width for a given maintenance operation. In a road maintenance example, it is common to use three foot (914 mm) and four foot (1219 mm) sections to create a variety of widths to match the plow mold board on a vehicle or tailor it to the width of the road.

Figure 9:
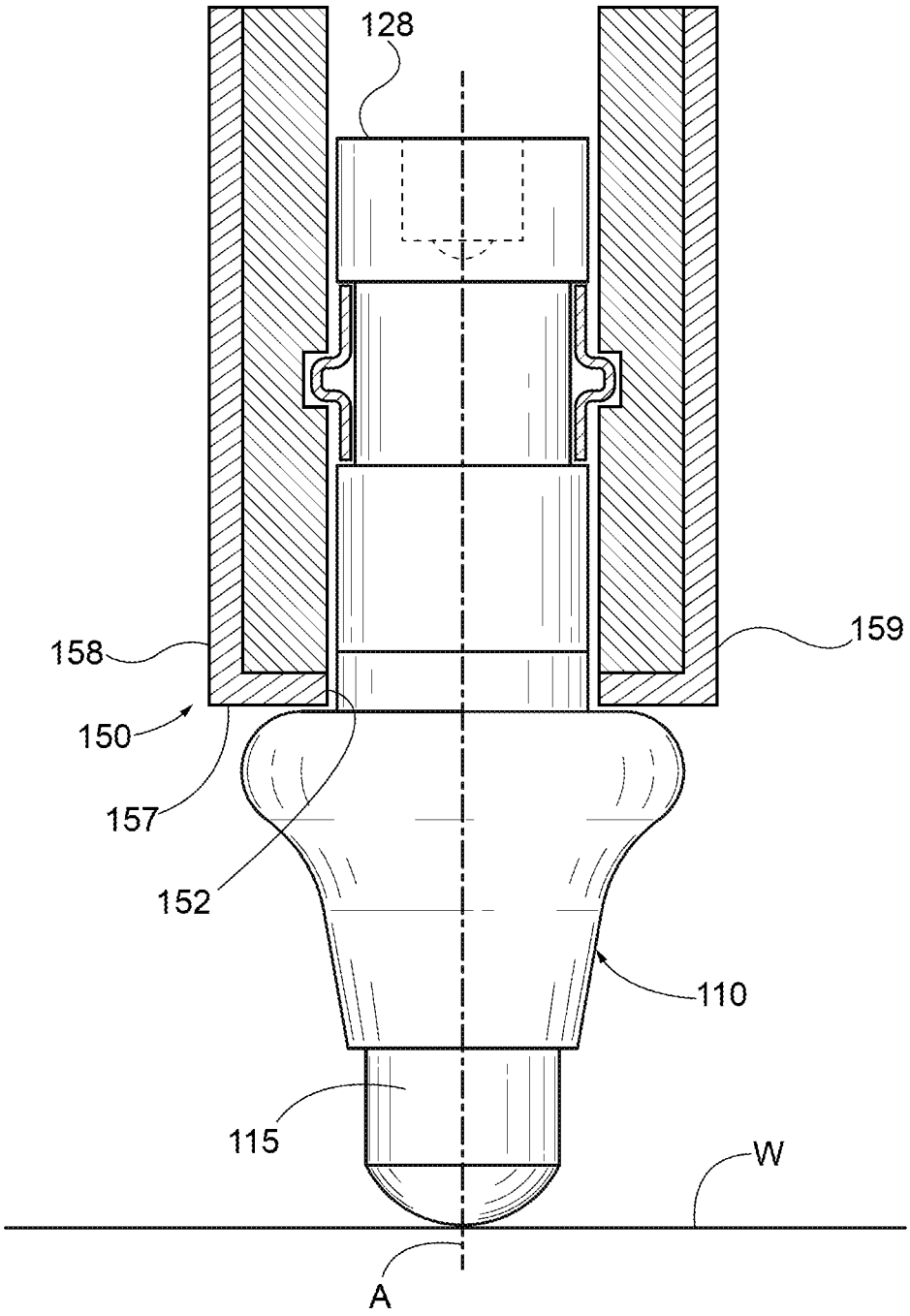
FIG. 9 is a partially sectioned side view showing a grader bit in contact with a work surface.

In general, the grader bit 100 is the wear component in a scarifier tool 10. With that in mind, the scarifier tool 10 supports a grader bit in a fashion that allows the tool to be replaced when it wears out. According to another example, it is desirable to allow the grader bit 100 to rotate. In the example, to rotatably support the grader bit 100, support 15 defines at least one bore 20 that receives a mounting portion, referred to as the shank, of the grader bit 100. A working portion or tool end of the grader bit 100 extends axially outward from the bore 20 and toward the surface to be worked W (FIG. 9). The angle of the bore 20 may be varied to define different angles of attack for moving the grader bit 100 along work surface W by scarifier tool 10, as described herein.

The grader bit 100 has a number of applications in the context of a scarifier tool. For purposes of example and without limitation, a grader bit is described herein in the context of a road maintenance application. For road grading, a grader bit may be attached to a mold board or similar construction implement to facilitate moving the grader bit 100 across a work surface W (FIG. 9). In such applications, plural bits may be supported adjacent to each other defining a working gap between the work surfaces 105, i.e., outer surfaces of the working end, of adjacent grader bits 100. The spacing of plural bits on support 15 may be regular or vary across the length depending on the application.

During operation of a scarifier 10, the grader bit 100 may be dragged across or through a surface to condition/groom the surface, machine it, or break it up. For example, road grader bits 100 may be mounted on a scarifier tool 10 to rake road material including but not limited to dirt, gravel, broken asphalt and other loose road materials. In this application, the grader bits 100 may be used to simply condition the surface by leveling it or raking troughs into the surface. In other applications, the same grader bits may be used to machine or break up material forming a road surface. In some instances, grader bits are used to break up hard packed snow, mud or ice built up on a road surface or to clear or rake debris.

In such applications, debris or particles from the road surface pass between adjacent bits. To facilitate passage of the debris, it is desirable to mount the grader bit 100 in a manner that permits it to rotate during operation. The rotation of grader bits 100 during operation helps clear debris and prevent uneven wear of grader bits 100. Ensuring proper rotation of the bits extends their useful life. As shown in drawing, grader bit 100 may have a cylindrical shank to facilitate rotation within a cylindrical bore 20 in support 15. To further facilitate rotation, a retainer 140 may be used to rotatably mount the grader bit within a bore 20. Retainer 140 may act as a journal allowing the shank of grader bit 100 to rotate while retainer 140 remains stationary within bore 20 as described elsewhere herein. In these examples, the shank may have a smaller diameter than the bore or non-cylindrical shape that accommodates retainer 140 while permitting free rotation therein.

Despite close tolerances between the bore within the support and the shank or clip structures, dust and other fine debris may become lodged between grader bit 100 and the bore 20 in a manner that inhibits or prevents rotation. For example, after performing a road grading operation, dust from cement mixed with water may find its way into the bore 20 or between retainer 140 and shank 120 of grader bit 100 and dry during an inactive period to form a cement-like material that inhibits or prevents rotation of the tool when it is next put into use. As discussed, this can cause grader bit 100 to wear prematurely shortening its useful life. Likewise, a lack of rotation affects the material flow between adjacent grader bits degrading the results of the road working process. This may require the same surface to be reworked to obtain the desired look or level of conditioning.

The accumulation of material and locking of a grader bit 100 within the bore is more common when use of the scarifier is interrupted by periods of downtime that allow the cementitious material to form within the bore 20. As a preventative measure, grader bits may be inspected to ensure that they are rotating, and if a grader bit 100 does not rotate freely, it is desirable to forcibly rotate the bit to break up any binding material within the bore 20 and work it out of the bore 20 to restore proper rotation. To that end, a grader bit having an extended shank having a polygonal portion that extends beyond a rear surface of a supporting structure was disclosed in U.S. Pat. No. 8,727,451 ("the '451 patent"). This patent also shows a polygon shape on a tool surface of the bit. The polygon shaped outer surfaces facilitate use of a wrench or socket to rotate the bit within the bore. These surfaces can be engaged by a hand wrench, pneumatic wrench, crescent-type wrench or other tool that can grasp the polygonal portion of the shank to rotate the shank and attempt to clear any accumulated debris. While this grader bit allows the user to rotate the bit within the bore, as described, this grader bit created other disadvantages. The extended portion is not supported within the support and is exposed to debris passing through the grader bits during operation. In practice, the extended portions can be bent or otherwise distorted during operation of the road grading machine or through inadvertent contact with the exposed portion, such as when reversing or dropping the scarifier. Such bending or distortion can make it difficult or impossible to remove the bit from the support when it is time for replacement. As can be appreciated, these bits often wear out during road grading operations making the time needed to replace a bit critical. Moreover, the operator may not have tools needed to dislodge or cut free a bit that has a bent extended portion. In such instances, the bit may not be able to be replaced until the road grader is taken back to a shop or other location where such tools are available. This downtime can interrupt expensive road projects delaying their completion and/or adding costs from crew downtime. More practically, this downtime may occur when crews are operating on busy roads slowing traffic and placing operators in the dangerous position of working on the scarifier near moving traffic. Also, the operator is forced to work outside the protection of the vehicle often in inclement weather conditions. Consequently, while the '451 patent improved the ability to force rotation of the bit, the extension of the bit beyond the board is undesirable. This bit has been on the market for over five years creating a long-felt need for a grader bit that can be rotated by an external driver that does not require a portion of the grader bit to extend outward of the bore.

As shown in the '451 patent, the extended portion of the shank also forms gaps between the wall of the bore in the support and the shank due to the polygonal shape. Since debris and dust flows into this area during operation, the gaps make it easier for debris to enter the rear of the bore and accumulate in a manner that inhibits rotation of the bit. It is common for road material debris such as fine concrete dust to accumulate in the gaps, absorb water used during removal operations, moisture in the air, rain water, or other moisture sources that cause the accumulated debris to form a cement material. This material dries and solidifies in the gap fixing the grader bit in the bore. The fixed bit cannot rotate as intended to properly maintain a flow of material through the grader bit array causing the bit to wear prematurely or unevenly necessitating its replacement. Replacing the bit requires a work stoppage and interrupts the road grading project delaying subsequent operations such as repaving, etc. Moreover, with the bit fixed in the support by the cement, it may be difficult to remove. The examples disclosed herein address one or more of these issues.

A grader bit according to an example is generally indicated by the number 100 in the accompanying drawings. Grader bit 100 has a tool body 110 that includes an outer surface or tool end 115 that engages a work surface, which as discussed may be a road surface constructed of dirt, rock, asphalt, cement or other suitable road materials. The surface may also include ice that needs to be cleared from the surface. A shank 120 extends from tool body 110. The tool body 110 and shank 120 share an axis A about which the grader bit 100 rotates as discussed more completely elsewhere herein.

The length of the shank 120 varies depending on the structure in which it is mounted and the type of retainer that is used. The shank length may also vary in connection with the type of application for the grader bit 100. As discussed elsewhere herein shank 120 may include a boss that is configured to facilitate manual rotation of the grader bit 100 within its supporting structure to clear debris or otherwise loosen a grader bit 100 that may not be freely rotating. According to the examples herein the shank length is less than the bore 20 in support 15. Suitable lengths include but are not limited to 20 mm to about 65 mm. For standard supports such as Kennametal® or Sandvik® grader mounting board, bore lengths may range from 22 mm to 70 mm. For most road maintenance applications, bore lengths ranging from 35 mm to 50 mm are common. In the examples shown having a shank including a boss (e.g., boss 165) to facilitate manual rotation of the bit within a support, lengths of about 33 mm to about 47.5 mm were suitable. The tool end length varies considerably based on the application for the tool, the type of carbide tip inserted and other factors. Example tool end lengths include but are not limited to about 30 mm to about 60 mm. In this instance and all others describing the dimensions of particular aspects of the disclosure, it is understood that these examples are non-limiting and that other sizes or geometries can be implemented without departing from the scope or spirit of the disclosure and relevant claims.

Figure 6:
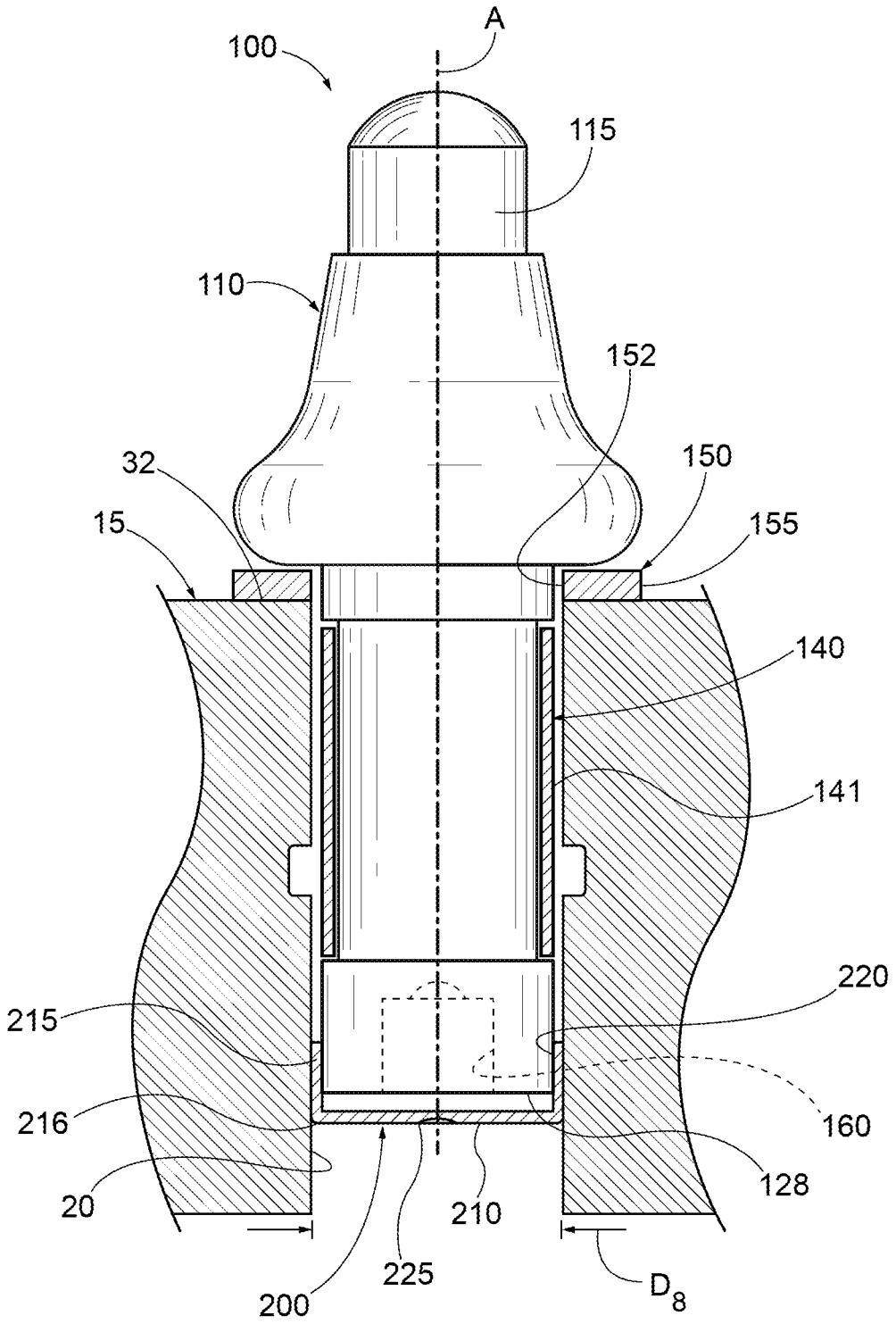
FIG. 6 is a partially sectioned side view showing a grader bit according to an example within a support with a cap installed.

According to an example, grader bit 100 includes a retainer 140 described more completely elsewhere herein. Retainer 140 may be used to facilitate mounting the grader bit 100 in a support and allowing it to rotate. To locate the retainer on shank 120 and limit axial movement of grader bit 100 once mounted within support, grader bit 100 may include a first shoulder 125 between tool body 110 and shank 120. In the example, first shoulder 125 has a first diameter $D_1$ larger than the diameter d of shank 120. A second shoulder 130 may be formed at the end of shank 120 opposite first shoulder 125. In the example, the diameter $D_1$ of first shoulder 125 and second diameter $D_2$ of second shoulder 130 are equal to each other. In other examples, these diameters may vary relative to each other. Also, in the example, diameters of first shoulder 125 and second shoulder 130 are less than the diameter DB of bore 20 (FIG. 6) allowing the portions of shank 120 defining shoulders 125, 130 to be received within the bore 20. In other examples, first shoulder diameter $D_1$ may be larger than the bore 20 to prevent receipt of first shoulder 125 within bore 20. To allow partial insertion, a conical or other cross-section that expands radially outward progressively along axis A may be used to form shoulder 125.

Figure 2:
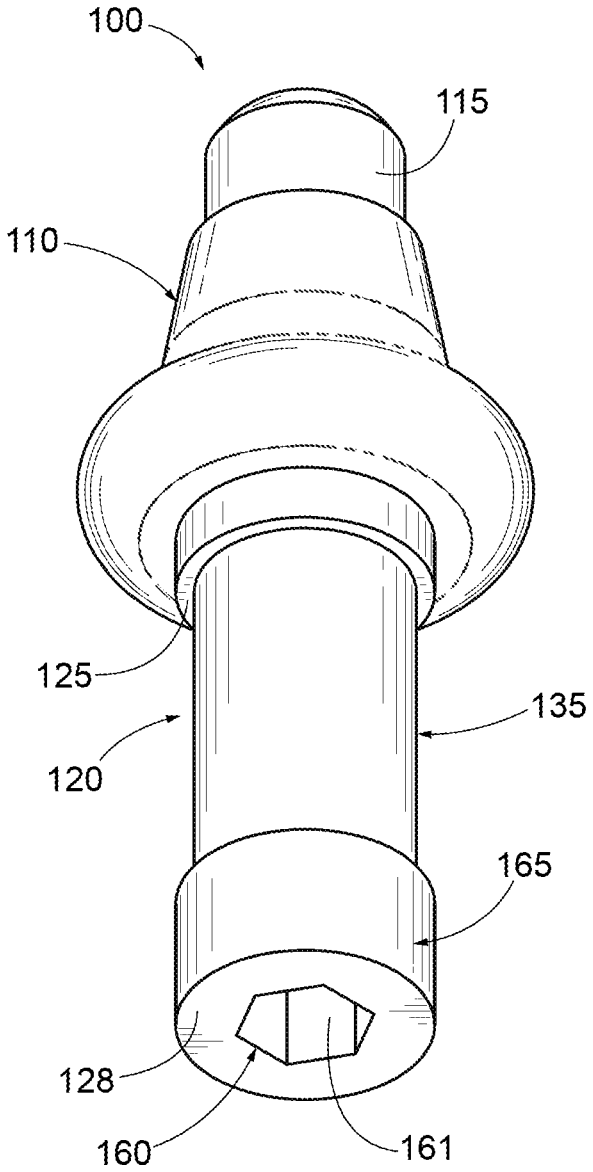
FIG. 2 is a bottom perspective view thereof.
Figure 3:
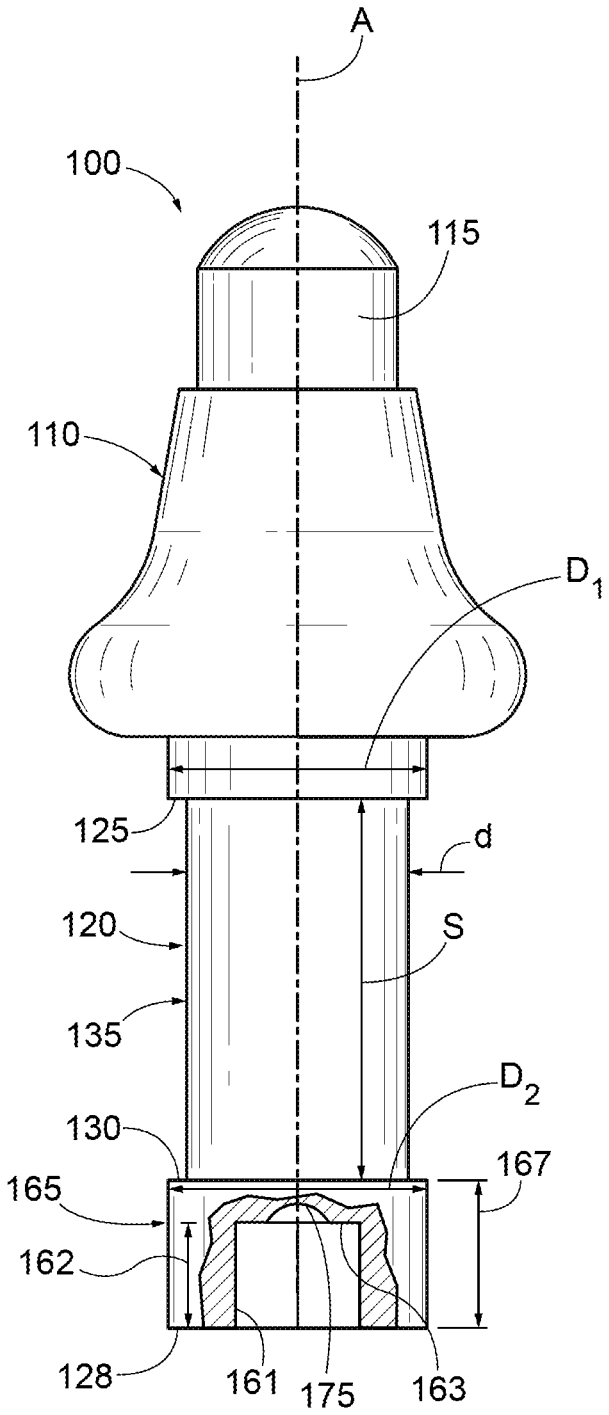
FIG. 3 is a side view thereof.
Figure 4:
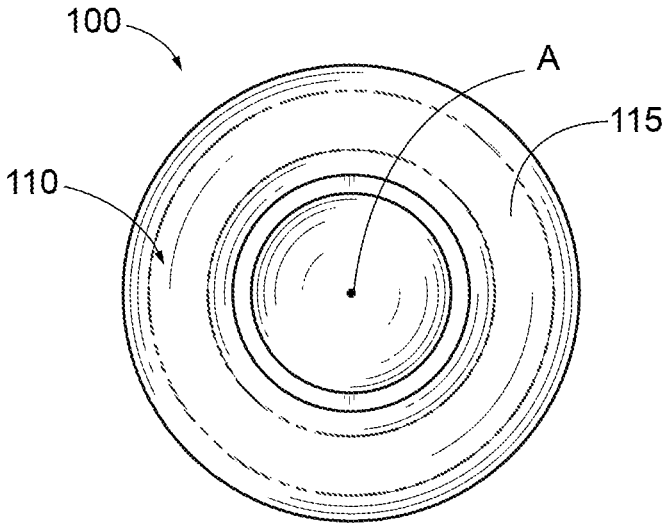
FIG. 4 is a top view thereof.
Figure 5:
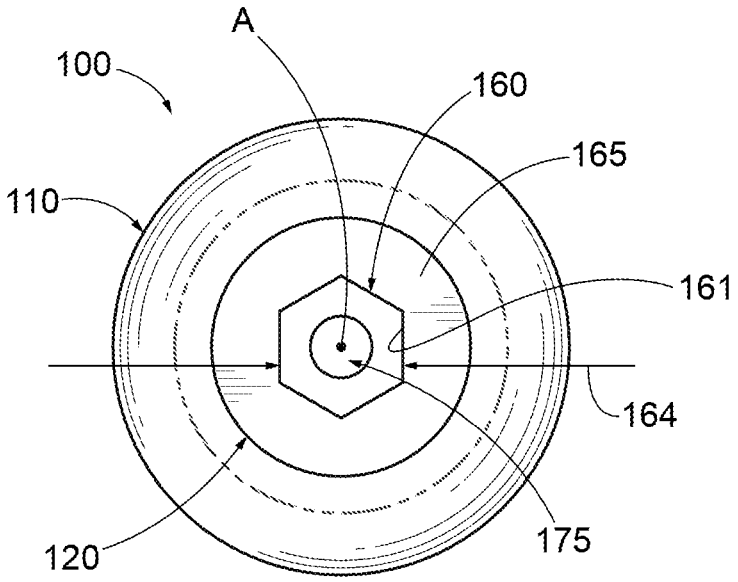
FIG. 5 is a bottom view thereof.

With reference to FIG. 2, the larger diameter of first shoulder 125 and second shoulder 130 relative to diameter d of shank 120 form a cylindrical recessed region 135 therebetween. A retainer 140, such as a circlip or the like may fit within recessed region about shank 120. The first shoulder 125 and second shoulder 130 axially restrain movement of retainer 140 and in turn the bit 100, as discussed herein. Once inserted within bore 20, retainer 140 holds grader bit 100 within the bore 20. As discussed, while holding the grader bit 100 axially, retainer 140 may act as a journal to permit rotation of the grader bit 100. Retainer 140 may vary in length, i.e., axial dimension, depending on the retainer type. Example retainers 140 may have a generally cylindrical shape with a long, medium, or short length to accommodate various bores in a support. An example long retainer length may be about 3 cm. An example, medium retainer length may be about 25 mm. An example short retainer length may be 12.75 mm. Other lengths may be used depending on the size of bore 20.

The axial dimension between first shoulder 125 and second shoulder 130 is referred to as a shoulder spacing S herein. Spacing S may be made to be about the same length as the retainer 140 to axially restrain movement of grader bit 100 through contact between shoulders 125, 130 and retainer 140. Spacing S may be made greater than the length of retainer 140 to allow some axial play if movement of grader bit 100 is desired and/or to accommodate additional structures mounted between the bit 100 and support 15 such as a washer or protective covering on support 15.

As referenced herein, shoulder spacing S may be determined by the type of retainer 140 used. For example, a retainer 140 having a longer axial dimension would require a longer spacing S than a retainer having a shorter axial dimension. As a result, the particular spacing S shown in the drawings is not limiting. Two examples of retainers 140 are shown. The first is a long sleeve retainer 141 that has a gap that facilitates compression of the retainer 140 allowing it to be inserted within a bore on support 15. A second example (FIG. 7) shows a short sleeve retainer 142, sometimes referred to as a "wedding band." Medium sleeve retainers are available as discussed herein. Spacing S in both examples is sized to be about the same as the length of retainer 140. A small tolerance may be provided to facilitate attaching the retainer on shank 120. For example, spacing S may be greater than length of retainer 140 by about 0.1 to about 2.75 mm. In general, spacing is between 12 mm and 35 mm to accommodate a retainer 140. For retainers having a length from about 12.75 mm to about 30 mm, spacing may range from about 12.85 to about 32.75 mm when providing a tolerance to facilitate attachment of the retainer 140. According to an example of a short retainer 140 having a length of 12.75 mm, a spacing ranging from about 12.85 to about 15.5 mm may be used. For a long retainer having a length of about 30 mm, a spacing from about 30.1 mm to about 32.75 mm may be used.

These examples provide a spacing suitable to facilitate installation of retainer 140 on shank 120 between first and second shoulders 125, 130 while at the same time providing minimal axial movement of the grader bit 100 once installed. Minimizing the movement of grader bit 100 once installed holds the grader bit 100 tight against the face of support 15 or holds bit and washer/protective cover (described herein) against support 15 to prevent dirt or debris from entering the bore 20 or otherwise interfering with rotation of grader bit 100. In the particular examples shown, spacing S is greater than the length of retainer by about 0.1 mm to about 2.75 mm. In other examples, the spacing S is greater than the length of retainer 140 by about 0.5 mm to about 1.5 mm. According to one example, for a short retainer, the spacing S is from about 13.25 mm to about 14.25 mm. For a large retainer, the spacing S is from about 30.5 mm to about 31.5 mm. As mentioned, this tolerance prevents dirt and debris from entering the bore 20 of the support 15. As noted, the problem of dirt and debris entering the bore is a constant battle. When debris enters the bore, it interferes with proper rotation of the grader bit. The rotation of the bits adjacent to each other clear the debris as the grader bit mills or grooms a road surface. When one bit is rotating at a different rate relative to an adjacent bit or is stopped, the debris is not cleared at the same rate or in the same manner causing that bit to wear unevenly relative to the other bits. When a bit is stopped, the uneven wear may be dramatic and deform the bit or cause the carbide tip to be dislodged such that the bit is not contacting the road surface at the same position as surrounding bits. This uneven wear or damage will require the bit to be removed and replaced forcing the road operation to stop until the bit is fixed. In an ideal situation, the bits on a support 15 all wear evenly such that they are all replaced at one time rather than stopping operations intermittently to replace individual bits. By providing a tight tolerance between spacing S and the retainer 140, axial movement of the grader bit 100 that would allow debris to slip between the tool end 115 or guard 150 (described more completely elsewhere herein) and the support 15 is minimized. By adding a cap (e.g., cap 200) at the opposite end of support as described more completely elsewhere herein, entry of debris from the rear side of support 15 can likewise be minimized effectively forming a sealed cavity housing the retainer 140 within support 15 in which the grader bit 100 rotates.

Figure 7:
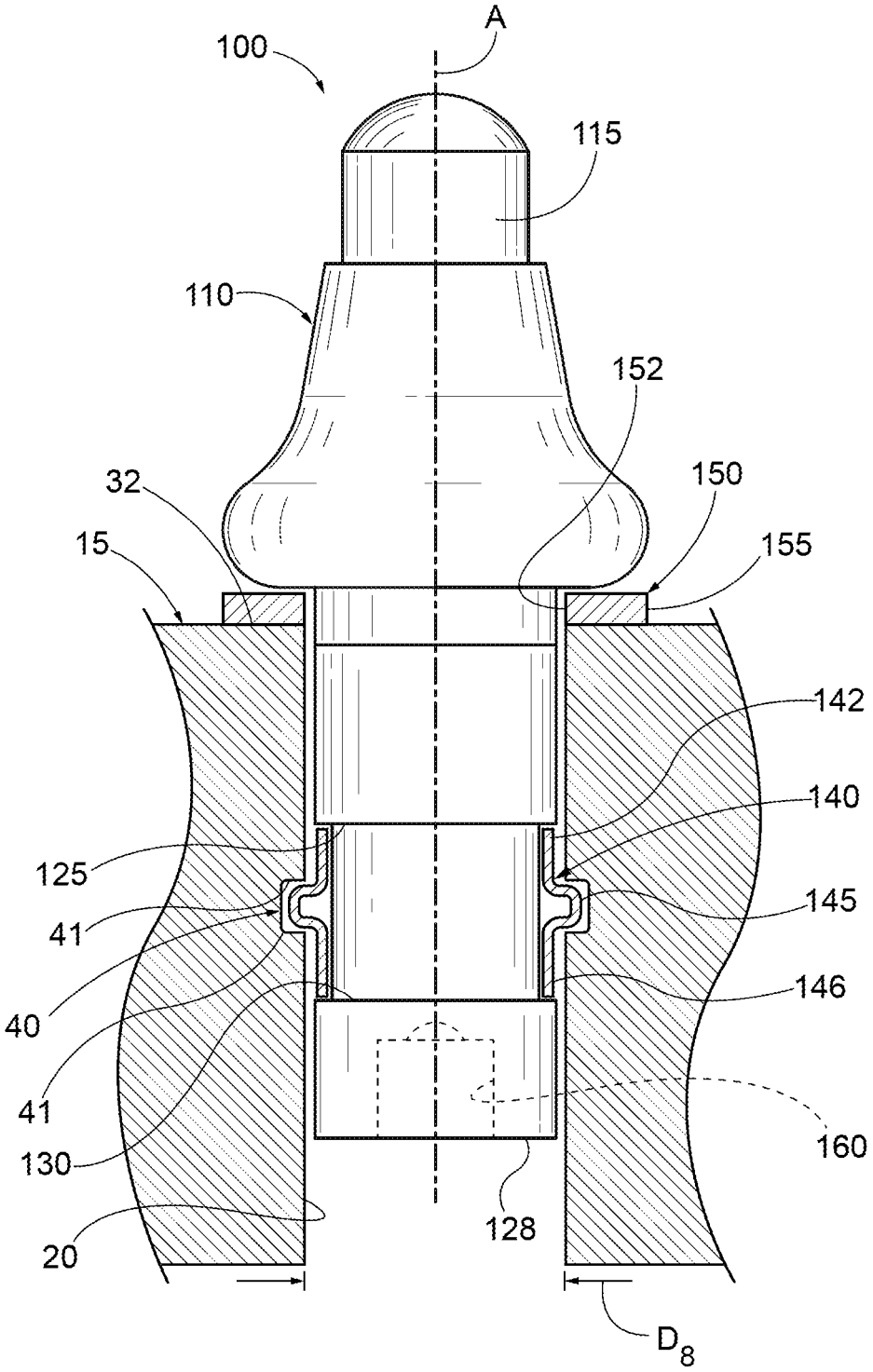
FIG. 7 is a partially sectioned side view similar to FIG. 6 showing a grader bit according to another example.
Figure 8:
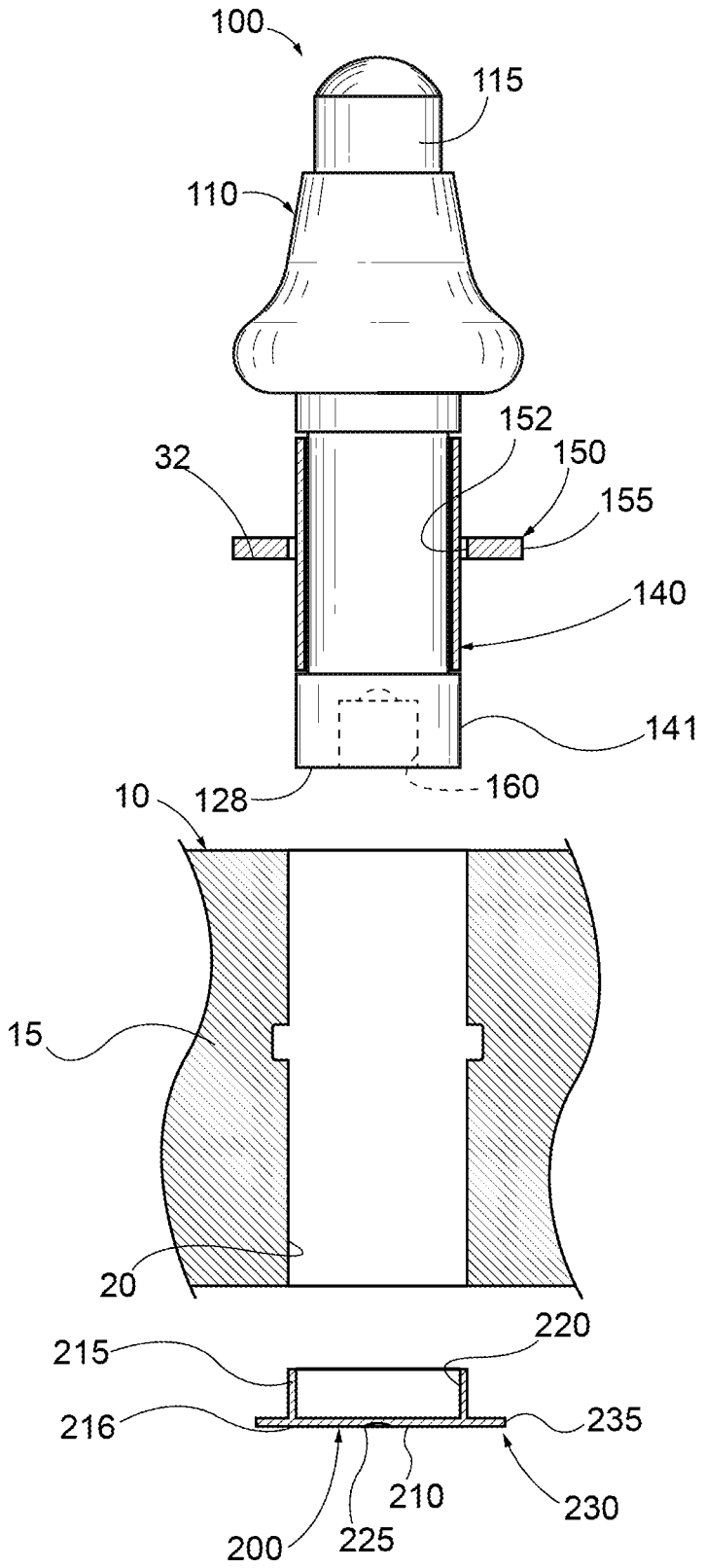
FIG. 8 is an exploded view showing installation of a grader bit and cap according to an example within a support.

The outer surface of the retainer 140 may be smooth and uninterrupted, as shown in the long sleeve example, or include a projection 145 used to engage a lip, groove or other surface within the bore to help fix the position of retainer 140 within bore 20. With reference to FIG. 7, an example is shown where support 15 includes an internal radial groove 40 that forms opposing lips 41 that capture and axially restrain retainer 140 once the projection 145 is received therein. Projection 145 may extend radially outward from outer surface 146 of retainer 140. The type of projection 145 may vary and include point projections such as a bump, cone or other shape formed on a limited portion of the retainer surface. In other examples, projection 145 may include a raised ring or band formed on the outer surface of retainer 140.

A support guard, generally indicated by the number 150, is provided between the grader bit 100 and support 15. Support guard 150 may be a flat plate-like member defining a guard bore 152 that receives shank 120 therethrough. Support guard 150 may act as a sacrificial surface that protects the outer surface 30 of support 15 from wear caused by rotation of bit 100. In this regard, support guard 150 may be a washer 155 that is sized to fit under grader bit 100 and space grader bit 100 away from support 15. To provide further protection for the exposed portions of support 15 located between bores 20, larger washers may be used including a square or rectangular washer that covers the face 32 of support 15. In the example, a flat washer is used. The washer 155 has a guard bore 152 that is sized to receive shoulder therethrough. According to another example shown in FIG. 9, guard 150 may include a cover plate 157 that fits over a section or entirety of a support 15 may be provided. Cover plate 157 may have plural openings corresponding to the bores within support to allow the plate to be held in place via insertion of the grader bits 100 within bores 20. Cover plate may be rectangular and simply cover the mounting surface against which the grader bits bear. Alternatively cover plate may include one or more sections 158, 159 that sweep back from the mounting surface to protect the support from debris that flows over these surfaces. For example, a first section 158 may cover a forward-facing edge of support 15 and a second section 159 may cover a rearward facing edge of support 15.

To facilitate mounting of a grader bit 100 including a guard 150, guard 150 may be initially mounted on retainer 140. Since the bore of guard 150 is similar to the bore of support, fitting the guard onto retainer 140 also has the benefit of compressing the retainer 140. This compression facilitates insertion of the shank 120 and retainer 140 into bore of support 15. As the grader bit 100 is inserted within bore, the guard 150 is held by support 15 allowing the retainer 140 to enter the bore 20 by sliding past guard 150. Eventually guard 150 clears retainer 140 releasing the compressive force on retainer causing it to expand within the bore of support and act as a journal for shank 120 as described herein.

As further discussed elsewhere herein, the flow of debris can inhibit rotation of grader bits 100 within bores 20. This causes premature wear or undesired results during operation since the rotation of the bits during a scarifier operation is essential to proper material flow between bits. With reference to FIG. 2, the axial outer end 128 of shank 120 includes a socket 160 or other recessed structure to facilitate removal of grader bit 100 or rotation of grader bit within bore 20 to clear debris. Socket 160 generally includes a socket wall 161 that extends axially inward from outer end 128 of shank 120. A socket base 163 may extend radially inward from the axial inward end of socket wall 161. Socket 160 may have any shape including but not limited to a polygon shape, such as a square, hexagon, and the like; a tool shape such as a triple square, star fastener, Phillips head or flat head; or custom designed socket shape limited only by the imagination of the designer. To that end, socket wall 161 may include at least one surface against which a tool bears to cause rotation of the grader bit 100. For simplicity such a bearing surface will be referred to herein as a facet. As shown socket wall 161 may define one or more facets to form the desired perimeter shape of socket 160. In the example, socket wall 161 defines 6 facets to form a hexagonal shaped perimeter for socket 160.

Socket 160 generally includes an axial dimension referred to as the depth 162 of socket 160 and a radial dimension or width 164. To facilitate clearing debris without removing grader bit 100 from bore 20, the socket may have a shape suitable for receiving a rotating tool. The depth 162 and width 164 of socket 160 is designed to accommodate a torque range suited to clear impediments by rotating the grader bit 100 within bore 20. The torque required varies depending on the type of materials encountered on the work site. Sandy loam requires less torque than dirt containing higher silica or sand content. Asphalt and cement materials may require greater torque. In instances where the grader bits have been allowed to sit and moisture has caused cement to reform within the bore, an even greater torque may be needed. For example, a torque of at least 10 Nm may be used to rotate grader bit 100 within bore 20 to clear debris. Suitable torque ranges to clear a variety of materials including debris from soils, asphalt and cement include 10-275 Nm. A tool adapted to fit within the socket may be inserted in socket 160 and rotated to force rotation of grader bit 100 while it is within bore 20. Tool may be rotated by hand with appropriate leverage or attached to an impact wrench or the like to further facilitate rotation.

To accommodate socket 160, shank 120 includes a boss 165 formed axially outward of second shoulder 125. Boss 165 has an axial dimension 167 and a radial dimension i.e., the diameter for the cylindrical shape shown. In the example, the radial dimension is the same as second diameter $D_2$. The diameter of boss 165 is less than the axial dimension of the bore 20 and greater than the diameter of the recessed region 135 of shank 120. Example diameters include a diameter of at least 15 mm to about 40 mm. Lighter duty applications, such as spreading, mixing, raking, grooming and the like may use a smaller diameter. Heavier duty applications including for example spot asphalt milling, tar sand road reclamation, chip and seal road reclamation, and snow and ice removal may require a larger diameter. Diameters of about 22 mm to about 35 mm are suitable for applications for breaking up road bed materials.

In general, the depth of socket 160 is less than the axial dimension 167 of boss 165. In some examples, the axial dimension of boss is at least 1.25 times the depth of socket 160. According to another example, the axial dimension of boss 165 is equal to or greater than a radial dimension of the socket 160. In some examples, the axial dimension of boss 165 is in a range of about 1 to about 2 times the radial dimension of socket 160. In other examples, the axial dimension of boss 165 is greater than twice the radial dimension of socket 160.

A removal recess, generally indicated by the number 175, may be provided in the base of socket 160 to facilitate removal of grader bit 100 from support 15. The retainer 140 holds grader bit 100 in support such that it may be necessary to drive the bit 100 axially from the bore 20 with a hammer and punch. Existing tools generally have a flat surface. Inevitably, the flat surface allows the punch to slip under the force of a hammer blow making it more difficult to drive the bit 100 from bore. In a four or five meter scarifier tool (depending on manufacturer), there may be approximately 100 bits. It will be understood that reducing the effort needed to remove each bit has a significant cumulative effect on operator effort and fatigue. Moreover, such improvements also save valuable time when bits need to be removed in the field to ensure continued operation of the scarifier. Thus, according to an example, a removal recess 175 may be formed in the base of socket 160 to facilitate removal with a punch or other tool that applies an axial force to the bit. As a preliminary matter, the socket 160 helps generally locate the punch and the walls of socket help support the punch reducing user effort. The removal recess 175 helps locate the tip of an air hammer, punch or other removal tool within the socket 160 and align the tool with axis A for maximum efficiency. Providing the removal recess 175 in the base of socket 160 requires the punch to be inserted within the socket causing the wall of socket to help locate and support the punch therein. In this way, less user effort is committed to holding the punch steady and in the correct location to maximize the force of the hammer blow. This is of particular usefulness when bits need to be removed in the field. Often scarifiers are mounted on the underbody of a vehicle such that the operator is working within a confined space or at an odd angle that makes it difficult to properly place the punch for maximum effort.

In the example, removal recess 175 is a conical recess defined in the base of socket. The conical shape is not limiting as recesses of other shapes that may be used including but not limited to a cylinder, hemisphere, square, pyramid, or other regular or irregular shape. The conical shape in the example includes a recess wall that extends radially inward as it extends axially inward from the base of socket 160 narrowing to a point on the axis A of grader bit 100. In this way, the slope of the recess wall guides the end of the punch toward the grader bit axis A. Aligning the punch on the axis A ensures that an axial force is applied along axis A to maximize the force needed to remove the bit 100 from bore 20. This alignment also reduces the likelihood that the force of the blow is directed off axis and causes damage or distortion of grader bit 100, retainer 140 or bore 20. Such damage or distortion may make the interface between the bit 100 and bore 20 unsuitable for further installation causing the operator to replace the entire support 15 or wedge the retainer in the board when the bit is removed causing further work to remove the bit 100 and/or retainer 140.

According to another example, grader bit 100 includes a cap 200 that fits over the socketed end of the shank to seal that end within bore 20. In general cap 200 includes an end plate 210 that is sized and shaped to conform to the shape of bore 20. A cap wall 215 extends axially inward from a perimeter 216 of end plate 210 defining a cylindrical recess 220 that fits over socketed end of bit 100. Cap 200 is sized to form an interference or friction fit that holds it within bore 20. Cap 200 may be pressed into bore 20 over socketed end to close bore 20. Cap 200 effectively encapsulates the socketed end of bit 100 within bore 20 further reducing the likelihood of debris entering the bore 20 and inhibiting rotation of the bit 100. It further prevents dirt and debris from accumulating within socket 160. End plate 210 of cap 200 may be constructed of a thin sacrificial material such that when punching a bit 100 from bore 20, the operator may simply punch through cap 200 to locate punch within socket 160. To facilitate this, end plate 210 may have a dimple, recess, or other concavity 225 aligned with socket 160 to locate the punch. Alternatively, operator may remove cap 200 prior to inserting a punch. To facilitate removal, cap 200 may include a projection, generally indicated at 230, such as a tab, hook or flange. Projection 230 may extend from the end plate 210 axially or radially away from support 15 to make it more accessible to the operator. In the example, projection 230 is an annular flange that extends radially outward from endplate to lie over a portion of support when cap 200 is installed in bore 20. The operator may pry the cap 200 from bore 20 by applying a force between the support 15 and flange 235, for example with a screw driver, pick or other suitable implement.

Cap 200 may be constructed of any material that is suitable for covering the end of the bit 100 within bore including but not limited to paper products, wood products, metals, plastics, rubbers, ceramics or combinations thereof. In the example shown, a metal material is used such as a thin walled steel or aluminum material. In addition to being suitable to cover the end of the grader bit 100 and remain within bore under operating conditions, these materials may be constructed with a thin wall that can be punctured by a punch. Considering that they may be used in a single use manner when punctured, the steel and aluminum materials were selected because of the ease of which they may be recycled. It is understood that other materials including any of the categories of materials described herein may also be selected with these purposes in mind. Therefore, the examples are not limiting.

Example 1. A grader bit comprising a tool end having a shank extending axially inward therefrom; the shank having a circular cross-section; wherein a first shoulder extends radially outward relative to the shank and is located axially inward of the tool end; a second shoulder extending radially outward relative to the shank is located axially inward of the first shoulder defining a spacing therebetween; the shank including a boss at an axial inward end thereof, the boss defining a socket extending inward into the shank from the axial inward extremity of the shank, wherein a perimeter of the socket includes at least one facet against which a force is applied to cause rotation of the shank.

Example 2. The grader bit of example 1, wherein the socket includes a floor defining a radially extending socket plane; and wherein the boss defines a recess extending axially outward from the socket plane, the recess having a radial dimension that is less than the radial dimension of the floor.

Example 3. The grader bit of example 2, wherein the recess is centered on the axis of the shank.

Example 4. The grader bit of example 1, wherein the boss defines a socket having a polygon shaped perimeter.

Example 5. The grader bit of example 4, wherein the polygon shaped perimeter has a hexagonal shape.

Example 6. The grader bit of example 1, wherein the socket includes a perimeter defining a star shape.

Example 7. The grader bit of example 1, wherein the second shoulder is formed by the boss.

Example 8. The grader bit of example 1, wherein the spacing between the first shoulder and the second shoulder is between 12 mm and 35 mm.

Example 9. The grader bit of example 1, wherein the spacing between the first shoulder and the second shoulder is from about 12.85 mm to about 32.5 mm.

Example 10. The grader bit of example 1, wherein the spacing between the first shoulder and the second shoulder is from about 12.85 to about 14.5 mm.

Example 11. The grader bit of example 1, wherein the spacing between the first shoulder and the second shoulder is from about 13.25 mm to about 14.25 mm.

Example 12. The grader bit of example 1, wherein the spacing between the first shoulder and the second shoulder is from about 30.1 mm to about 32.5 mm.

Example 13. The grader bit of example 1, wherein the spacing between the first shoulder and the second shoulder is from about 30.5 mm to about 31.5 mm.

Example 14. The grader bit of example 1, wherein the tool end includes a tool surface forming a frusto-conical shape that narrows radially as it extends axially outward from the shank.

Example 15. The grader bit of example 1 further comprising a carbide tip supported on an axial outward extremity of the tool end.

Example 16. The grader bit of example 15, wherein the carbide tip is attached to the tool end by a brazing.

Example 17. The grader bit of example 1 further comprising a washer, the washer defining an opening configured to receive the first shoulder therethrough, and wherein the axial inward end of the tool end extends radially outward of the opening in the washer.

Example 18. The grader bit of example 1 further comprising a retainer supported on the shank between the first shoulder and the second shoulder.

Example 19. The grader bit of example 1 further comprising a cover plate comprising a front surface and a pair of edge surfaces extending inward from the front surface; the front surface defining at least one opening to receive the shank therethrough.

Example 20. The grader bit of example 1 further comprising a retainer supported on the shank between the first shoulder and second shoulder, wherein the spacing between the first shoulder and second shoulder is greater than an axial dimension of the retainer by greater than 0.1 mm and less than 2.75 mm.

Example 21. A grader bit comprising a tool end and a shank; the shank extending inward from the tool end, the shank having a circular cross-section defining an axis; wherein the shank includes a first shoulder located inward of the tool end, and a second shoulder located inward of the first shoulder, wherein the first shoulder and second shoulder are separated from each other by a spacing; the first shoulder having a first diameter, the second shoulder having a second diameter, and a portion of the shank between the first shoulder and second shoulder having a diameter, wherein the first diameter and second diameter are greater than the diameter of the shank between the first shoulder and second shoulder; the shank including a boss at an axial inward end thereof, the boss defining a socket extending from an end of the boss toward the second shoulder, the socket including at least one wall forming a perimeter of the socket, wherein the at least one wall includes at least one facet against which a force is applied to cause rotation of the shank; a retainer supported on the shank between the first shoulder an second shoulder, wherein the spacing between the first shoulder and second shoulder is greater than the length of the retainer by no less than 0.1 mm and no more than 2.75 mm.

As used herein, spatially orienting terms such as "above," "below," "upper," "lower," "inner," "outer," "right," "left," "vertical," "horizontal," "top," "bottom," "upward," "downward," "laterally," "upstanding," et cetera, can refer to respective positions of aspects as shown in or according to the orientation of the accompanying drawings. "Inward" is intended to be a direction generally toward the center of an object from a point remote to the object, and "outward" is intended to be a direction generally away from an internal point in the object toward a point remote to the object. Such terms are employed for purposes of clarity in describing the drawings, and should not be construed as exclusive, exhaustive, or otherwise limiting with regard to position, orientation, perspective, configuration, and so forth.

Various embodiments herein need not include the described and/or illustrated geometries. A hexagonal socket, square, triple square, star or square socket merely suggest some possible embodiments that are suitable as described herein. Other various polygonal shaped sockets can be employed. More generally, the embodiments shown are not limiting. For example, straight-line geometries can be employed in place of rounded portions and vice versa. Diameters d and D can instead represent lengths, widths, and so forth. Thus, while one or more particular embodiments have been described in detail, these details are not to be interpreted as exhaustive or exclusive.

Similarly, the materials referenced herein are not limiting. The grader bit according to the disclosure can be constructed of various materials depending on the intended application. One or more portions of the grader bit can be made of different types of plastic, metal, ceramic, rubber, glass, carbon, combinations thereof, and/or other suitable materials depending on the application for the grader bit. For example, for a grader bit used in road surface applications, a metal, such as steel may be used to form the grader bit. To improve wear life, the tip of the grader bit may be constructed of a hardened steel or carbide material.

While principles and modes of operation have been explained and illustrated with regard to particular embodiments, it must be understood that this may be practiced otherwise than as specifically explained and illustrated without departing from its spirit or scope of the disclosure. What has been described includes examples of the subject innovation. It is, of course, not possible to describe every conceivable combination of components or methodologies for purposes of describing the claimed subject matter, but one of ordinary skill in the art may recognize that many further combinations and permutations of the subject innovation are possible. Accordingly, the claimed subject matter is intended to embrace all such alterations, modifications, and variations that fall within the spirit and scope of the appended claims.

Specific embodiments of an innovation are disclosed herein. One of ordinary skill in the art will readily recognize that the innovation may have other applications in other environments. In fact, many embodiments and implementations are possible. The following claims are in no way intended to limit the scope of the subject innovation to the specific embodiments described. Only a recitation of "means for" is intended to evoke a means-plus-function reading of an element and a claim, whereas, any elements that do not specifically use the recitation "means for", are not intended to be read as means-plus-function elements.

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the elements described (e.g., enclosures, sides, components, assemblies, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open.

What is claimed is:

1. A grader bit comprising:

a tool end having a shank extending axially inward therefrom, the shank having a circular cross-section;

a first shoulder extending radially outward relative to the shank, wherein the first shoulder is located axially inward of the tool end;

a second shoulder extending radially outward relative to the shank is located axially inward of the first shoulder defining a spacing therebetween;

a boss at an axial inward end of the shank, the boss defining a socket extending inward into the shank from the axial inward end of the shank, wherein a perimeter of the socket includes at least one facet against which a force is applied to cause rotation of the shank; and a scarifier board, the scarifier board including a support, the support defining at least one bore extending from an axial outer surface of the support to an axial inner surface of the support, wherein the boss received within the bore and has a diameter less than a diameter of the bore to permit rotation of the boss within the bore; and wherein the retainer engages a portion of the support to fix an axial position of the boss within the bore, such that an axial inward surface of the boss lies within the bore and does not protrude beyond a plane defined by the axial inward surface of the support around the bore.

2. The grader bit of claim 1, wherein the socket includes a floor defining a radially extending socket plane; and wherein the boss defines a recess extending axially from the socket plane toward the shank, the recess having a radial dimension that is less than the radial dimension of the floor.

3. The grader bit of claim 2, wherein the recess is centered on the axis of the shank.

4. The grader bit of claim 1, wherein the boss defines a socket having a polygon shaped perimeter.

5. The grader bit of claim 4, wherein the polygon shaped perimeter has a hexagonal shape.

6. The grader bit of claim 1 further comprising a retainer supported on the shank between the first shoulder and second shoulder, wherein the spacing between the first shoulder and second shoulder is greater than an axial dimension of the retainer by greater than 0.1 mm and less than 2.75 mm.

7. The grader bit of claim 1, wherein the second shoulder is formed by the boss.

8. The grader bit of claim 1, wherein the spacing between the first shoulder and the second shoulder is between 12 mm and 35 mm.

9. The grader bit of claim 1, wherein the spacing between the first shoulder and the second shoulder is from about 12.85 mm to about 32.5 mm.

10. The grader bit of claim 1, wherein the spacing between the first shoulder and the second shoulder is from about 12.85 to about 14.5 mm.

11. The grader bit of claim 1, wherein the spacing between the first shoulder and the second shoulder is from about 13.25 mm to about 14.25 mm.

12. The grader bit of claim 1, wherein the spacing between the first shoulder and the second shoulder is from about 30.1 mm to about 32.5 mm.

13. The grader bit of claim 1, wherein the spacing between the first shoulder and the second shoulder is from about 30.5 mm to about 31.5 mm.

14. The grader bit of claim 1, wherein the tool end includes a tool surface forming a frusto-conical shape that narrows radially as it extends axially outward from the shank.

15. The grader bit of claim 1 further comprising a carbide tip supported on an axial outward extremity of the tool end.

16. The grader bit of claim 1 further comprising a cap that fits over an end of the shank, the cap including a projection.

17. The grader bit of claim 1 further comprising a guard, the guard defining an opening configured to receive the first shoulder therethrough, and wherein an axial inward end of the tool end extends radially outward of the opening in the guard.

18. The grader bit of claim 1 further comprising a retainer supported on the shank between the first shoulder and the second shoulder.

19. The grader bit of claim 1 further comprising a cover plate comprising a front surface and a pair of edge surfaces extending inward from the front surface; the front surface defining at least one opening to receive the shank therethrough.

* * * * *